United States Patent [19]

Krutenat

[11] 4,178,109

[45] Dec. 11, 1979

[54] METHOD FOR THE DISPOSAL OF NUCLEAR OR TOXIC WASTE MATERIALS

[76] Inventor: Robert A. Krutenat, Rte. 1, Box 471, Chimacum, Wash. 98325

[21] Appl. No.: 840,688

[22] Filed: Oct. 11, 1977

[51] Int. Cl.[2] ..... E21F 17/16; G21F 9/36

[52] U.S. Cl. ..... 405/128; 221/86

[58] Field of Search ..... 61/0.5, 35; 252/301.1 W; 405/53, 55, 128, 258

[56] References Cited

U.S. PATENT DOCUMENTS

| | | | |
|---|---|---|---|
| 3,108,439 | 10/1963 | Reynolds | 61/0.5 |
| 3,236,053 | 2/1966 | Billue | 405/53 |
| 3,262,274 | 7/1966 | Nelson, Jr. | 61/0.5 |
| 3,379,013 | 4/1968 | Slagle et al. | 61/0.5 |
| 3,513,100 | 5/1970 | Stogner | 252/301.1 W |

*Primary Examiner*—Mervin Stein

*Attorney, Agent, or Firm*—R. S. Sciascia; Charles D. B. Curry

[57] ABSTRACT

The earth has several subduction zones where the tectonic plate descends, adjacent the nondescending earth crust, into the central region of the earth. Described is a method and apparatus for the disposal of nuclear and other toxic waste materials comprising the placing of the waste materials into bore holes drilled in the tectonic plate at the edge of the subduction zone and allowing the descending tectonic plate to carry the waste material into the center of the earth. Millions of years are required before the waste can return to the earth's environment and, therefore, the decay of the waste material over this time span will render it harmless. The apparatus comprises re-entry towers that are positioned over the bore holes for loading into the bore holes waste materials made in the form of elongated cylinders or waste material made in the form of spheres.

11 Claims, 4 Drawing Figures

METHOD FOR THE DISPOSAL OF NUCLEAR OR TOXIC WASTE MATERIALS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention.

The present invention relates to the disposal of nuclear or toxic waste materials and more particularly to the method for the permanent disposal of these materials by placing them in the descending tectonic plate at the edge of the subduction zone.

2. Description of the Prior Art.

The disposal of radioactive wastes from nuclear reactors and other activities of atomic energy research, is a problem facing world socity. This problem arises from the long half-life of the radioactive waste products and the toxicity of the chemical compounds in which the radioactive material is found. The magnitude of the problem can be seen from the realization that about 2.23 $m^3$ of solid waste are produced by a conventional 1,000 MW reactor each year and five hundred such reactors would produce approximately 1,115 $m^3$ of solid waste each year. Plutonium 239, which is part of the solid waste of these reactors, has a half-life of nearly 25,000 years. Ten half-lives are required to reduce the radioactivity by a factor of 1,000 which is generally considered the required safety level. Thus it is estimated the buried Plutonium 239 wastes must be kept out of the biosphere or environment for 250,000 years or longer. The requirement is to dispose of this material in a manner and location where it is impossible for the waste to find its way back into the environment for at least 250,000 years and preferably longer.

The present accumulation of processed nuclear waste is stored in large vats of water, while a cooling process takes place. Sites such as salt domes, desert storage areas and ocean sediment deposits are being surveyed for use as permanent disposal areas. The major difficulty with these sites is that natural upheavals could cause the release of waste from salt domes or sediment deposits. In addition, any land storage is subject to undesirable future human tampering. Moreover, these wastes are thermally hot and may melt the salt in the salt domes, unless expensive cooling procedures are operative, and thereby escape their environment. Another major concern in waste disposal is that land located waste may seep back into or otherwise contaminate our water supplies.

Early in 1960, geophysicists realized that the crust of the earth was formed of large solid basaltic plates moving relative to each other. These large basaltic plates are formed at ocean ridges and return to the center of the earth at places known as "subduction" zones. The plates re-enter the earth at about 6 cm per year.

In accordance with the method and apparatus of the present invention the above described problems are overcome by placing the waste material in bore holes made in the basement rock of an oceanic plate at the edge of its subduction zone. This allows the crustal movement of the basement rock to carry the waste to the interior of the earth. About 58 million years are required before this waste material might again find its way to the earth's surface. Sufficient distances of subduction oceanic plate exists west of Washington and Oregon and south of the Aleutian chain to accommodate the waste output of the world for many centuries.

SUMMARY OF THE INVENTION

Briefly, the present invention comprises the use of the subduction zones where the tectonic plate descends, adjacent the nondescending earth crust, into the central region of the earth. It comprises a method and apparatus for the disposal of nuclear and other toxic waste materials comprising the placing of the waste materials into bore holes drilled in the tectonic plate at the edge of the subduction zone and allowing the descending tectonic plate to carry the waste material into the center of the earth. Millions of years are required before the waste can return to the earth's environment and, therefore, the decay of the waste material over this time span will render it harmless. The apparatus comprises re-entry towers that are positioned over the bore holes for loading into the bore holes waste material made in the form of elongated cylinders or waste material made in the form of spheres.

Statement of the Objects of the Invention

An object of the present invention is to provide adequate and safe disposal of nuclear and toxic waste materials;

Another object is to safely dispose of nuclear waste materials by causing them to be carried into the central region of the earth;

Still another object of the present invention is to provide a method for disposing of nuclear waste by placing and sealing the nuclear waste in bore holes made in the tectonic plate in the subduction region and adjacent the nondescending earth crust whereby the tectonic plate and nuclear waste descend into the central region of the earth;

A still further object of the present invention is to provide re-entry tower apparatus that are positioned over bore holes for loading into the bore holes nuclear waste material made in the form of elongated cylinders or nuclear waste material made in the form of spheres;

Other objects, advantages and novel features of the invention will become apparent from the following detailed description of the invention when considered in conjunction with the accompanying drawings wherein:

DESCRIPTION OF THE PREFERRED EMBODIMENT

Figure 1:
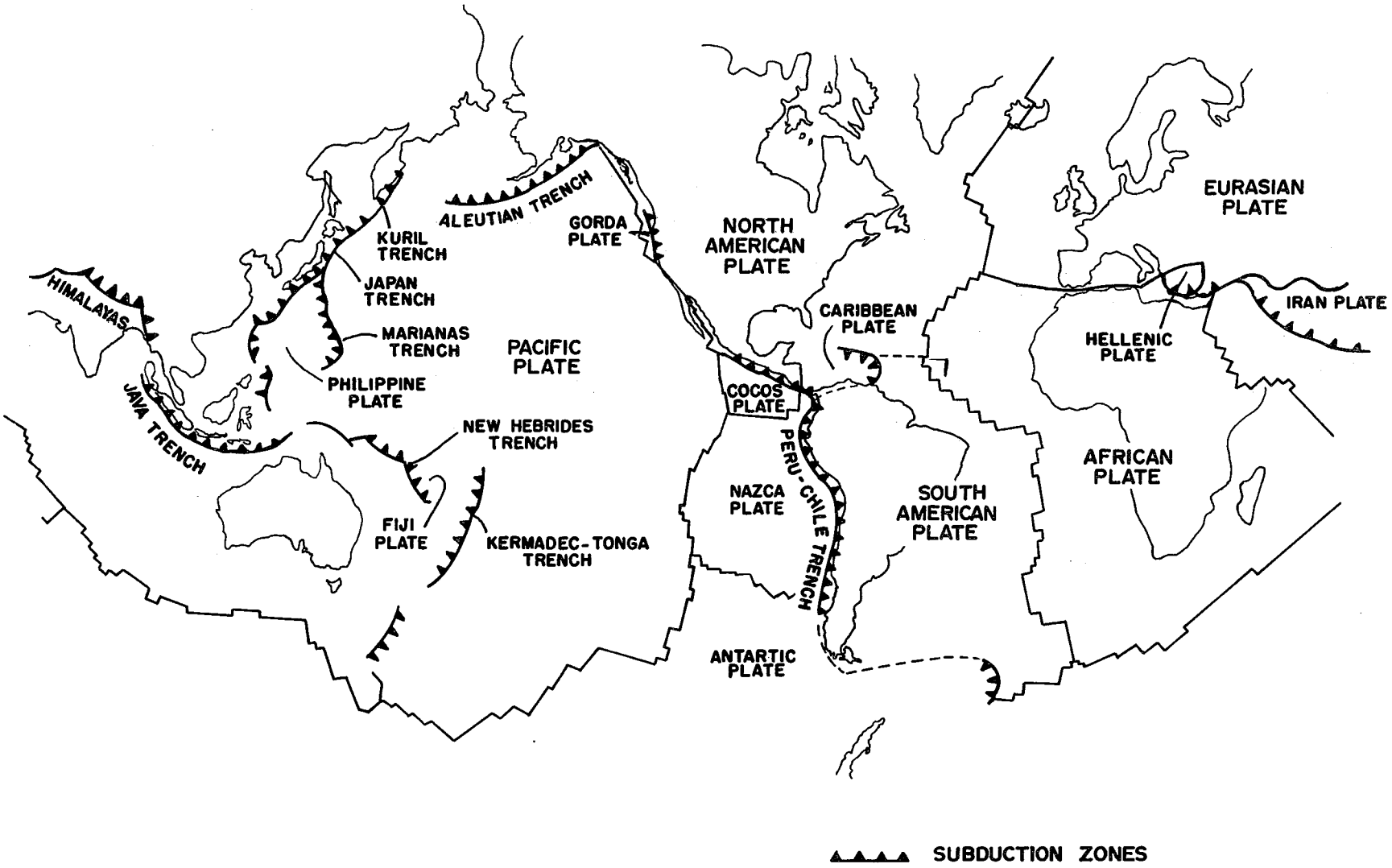
FIG. 1 is a map showing the locations of the subduction zones throughout the world.

In FIG. 1 is a map showing the locations of the subduction zones throughout the world. Two subduction zones are located within 200 miles of United States territory as illustrated in FIG. 1. These are the Gorda Plate and the Pacific Plate. The Gorda Plate subduction zone is west of the coast of Washington and Oregon, about 126° W, 46° N, and the Pacific Plate subduction zone is south of the Aleutian Chain, about 160° W, 55° N. Both of these subduction zones are about one mile under the ocean. The subduction zones are accurately definable by conventional survey techniques.

Figure 2:
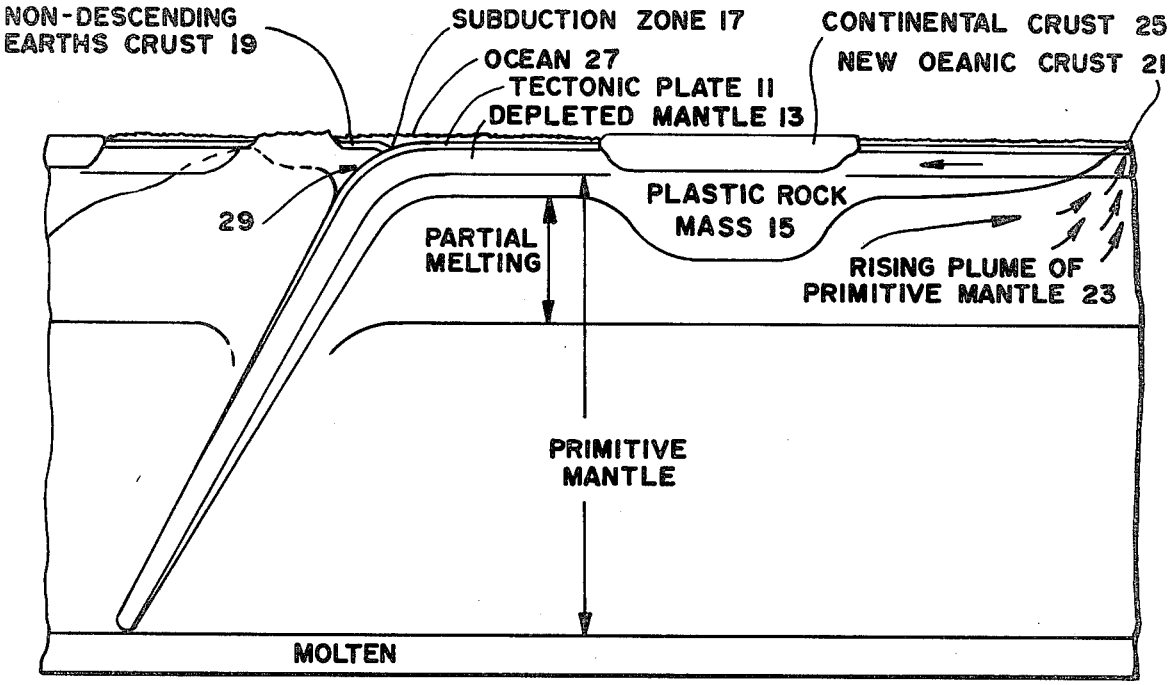
FIG. 2 is a composite illustration of the areas of the earth's crustal formation where the subducting effect is found.

In FIG. 2 is a composite illustration of the areas of the earth's crustal formation where the subduction effect is found. From FIG. 2 it can be seen that the descending lithosphere includes the tectonic plate 11, the depleted mantle 13 and some semi-plastic rock mass 15. At the subduction zone 17, that region denoting the boundary between the tectonic plate 11 and the non-descending earth crust 19, the tectonic plate descends at a rate of about 6 cm per year into the central region of the earth. This phenomena is a result of the generation of new oceanic crust 21 by the rising plume of primitive mantle 23. The new oceanic crust 21 (which is the tectonic plate) moves to the left as indicated by the arrows in FIG. 2. The continental crust 25 does not exist off the U.S. coasts but would comprise the North American Plate, for example. The tectonic plate 11 is illustrated as being covered with ocean water 27 and comprises the basaltic ocean crust and continental crust. Generally only the lower region of the continental crust is basalt. The tectonic plate 11 is a very hard contiguous basalt rock that descends back into the center of the earth at the subduction zone 17. It is estimated that it takes 58,000,000 years for the material in the tectonic plate at the subduction zone to descend downwards as a solid, then melt at a depth of several hundred kilometers, then mix and become part of the liquid rock currents and then become available for return to the surface of the earth. This time is far in excess of the time required for nuclear or other toxic waste materials to become completely harmless. In addition to time, heat and pressure within the earth are very effective in rendering the materials harmless. In can be seen that the Plutonium 239 that is placed in boreholes in the tectonic plate 11 at the subduction zone 17 will reach a depth of about 15 kilometers (see reference numeral 29) when it becomes harmless, due to the rate of 6 cm per year and the 250,000 years needed for Plutonium 239 to become harmless. The thinning out of the tectonic plate as it descends into the earth is due to partial plasticizing and an increase in the rate of descent with increase in depth.

Figure 3:
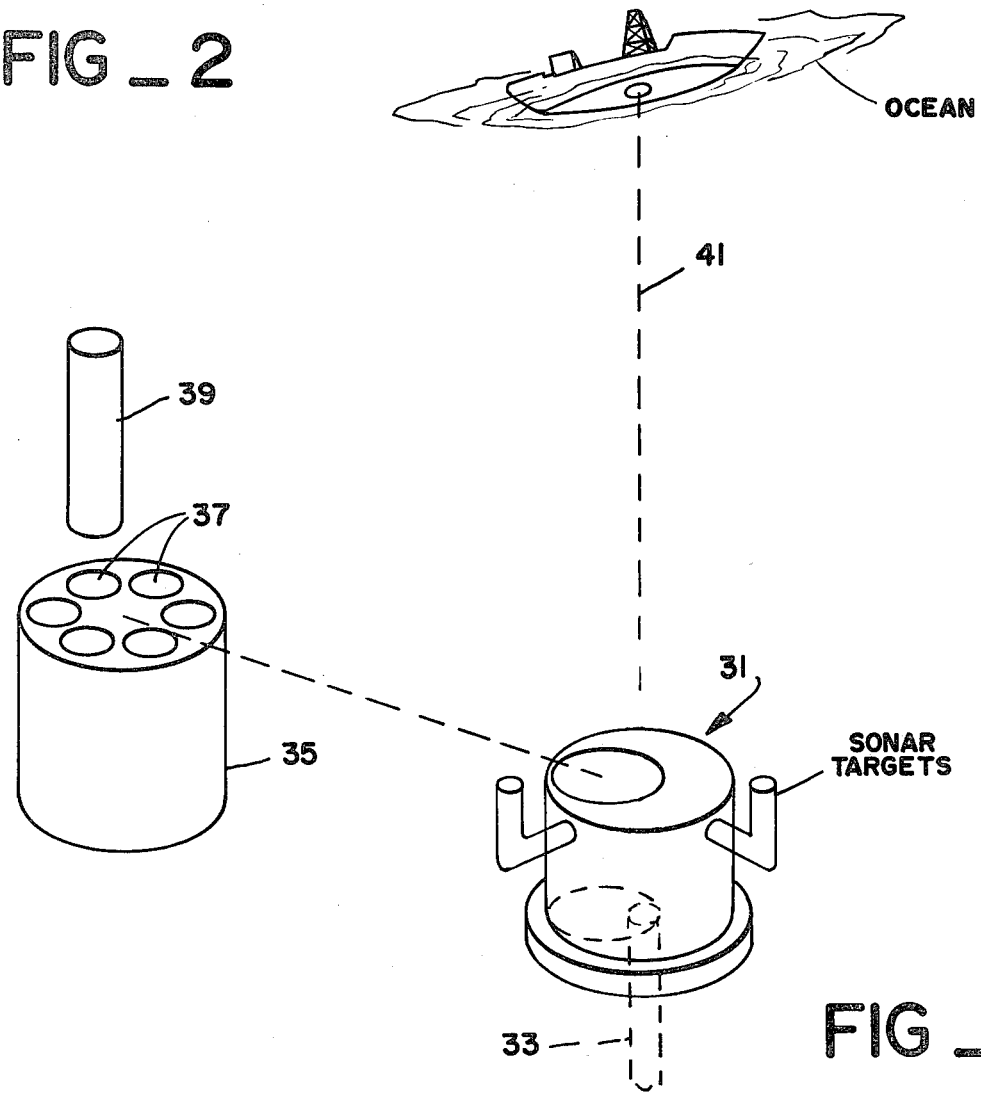
FIG. 3 is an apparatus for loading into bore holes waste materials made in the form of elongated cylinders.

In FIG. 3 is illustrated a re-entry tower apparatus 31 that is centered over a borehole 33 made in tectonic plate 11 at the subduction zone 17. The re-entry tower is cylindrical and has a revolving cylinder 35 that has a plurality of cylindrical openings 37 for receiving a plurality of waste cylinders 39. The revolving cylinder 35 is rotatably mounted in an offset position in the re-entry tower such that the innermost opening 37 is positioned directly in the center of the tower and is directly over the borehole 33.

In operation, a loaded revolving cylinder 35 is loaded by the drill string 41, suspended from a ship, for example, into the re-entry tower 31 and is rotated by the drill string. After a waste rod 39 is released, by a release mechanism, not shown, and dropped into the borehole 33, the revolving cylinder is rotated to the next position where the next waste rod is released. It should be noted that current practice is to slurry and harden a mixture of glass and nuclear waste material and form it into a cylinder that has a diameter of about 1 foot and a length of about 10 feet. This is then encased in a cylindrical steel jacket. The ocean water in the borehole will slow the gravity induced descent of the released waste cylinder 39 so that it will not break upon impact. However, it should be noted that breakage of the rod after it enters the borehole will not be detrimental since the material cannot escape from the hole. Therefore, the elimination of the outer steel jacket is feasible. The borehole is preferably made to a depth of about 1,000 meters and has a diameter of about 0.3 meters (1 foot). The hole may be filled with about 300 rods (about 900 meters) and the last 100 meters filled and sealed with cement.

Figure 4:
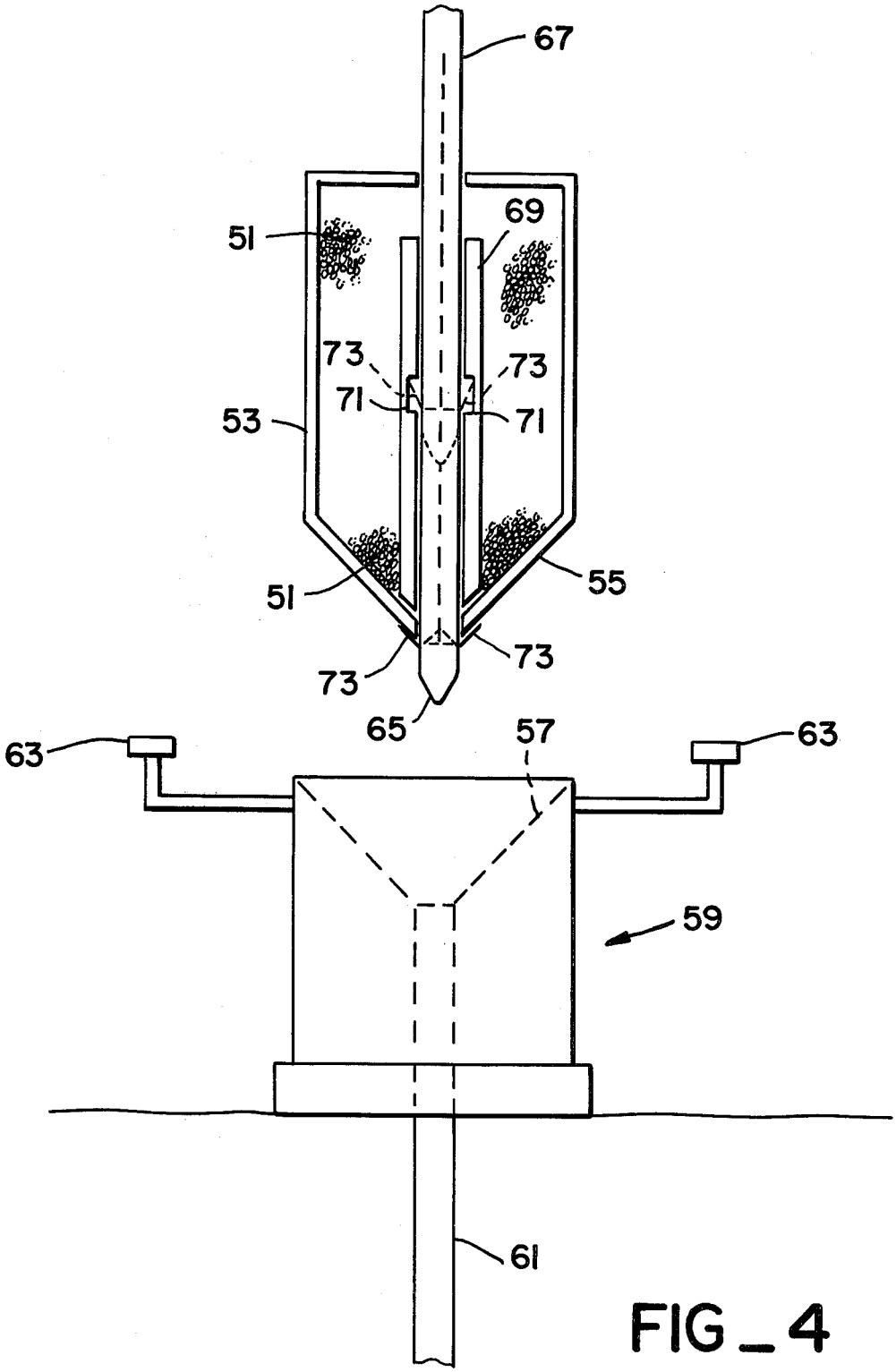
FIG. 4 is an apparatus for loading into bore holes waste materials made in the form of spheres.

In FIG. 4 is illustrated another apparatus for loading the boreholes with nuclear waste material. In this embodiment the nuclear waste material is mixed in a slurry of glass and formed into spheres 51 that may be about 1 inch in diameter, for example. The spheres 51 are placed in a cylindrical hopper 53 having a tapered end section 55 that is received by a mating conical section 57 in the re-entry tower 59. The re-entry tower is centered over the bore hole 61 and includes sonar targets 63. The head 65 of drill string 67 includes a TV camera and sonar for locating the sonar targets 63. A collar 69 is centrally positioned in the hopper and includes locking detents 71 for receiving locking dogs 73 that are mounted near the end of the drill string 67. The locking dogs 73 may be hydraulically actuated and will lock the hopper and drill string in the lowermost position, as shown by the solid lines, for raising and lowering the hopper by the drill string suspended from a ship, for example. After the hopper is mounted on and locked to the re-entry tower then the dogs are retracted and the drill string raised to where the dogs are adjacent detents 71 where they are actuated outwardly and into engagement with detents 71, as indicated by the dotted lines. The drill string is then raised which then raises sleeve 69 which allows the waste spheres to enter the drill hole by gravity action. When the hopper is empty then the drill string is lowered, the latching dogs retracted, and then extended to engage the bottom of the hopper. Then the hopper is unlocked from the re-entry tower, by locking mechanisms not shown, and raised by the drill string to the ocean surface for another loading of waste spheres.

It should be noted that the hopper has a dual protection system for preventing the accidental loss of waste spheres 51. That is, both sleeve 69 and drill string 67 prevent the exit opening of the hopper from receiving the waste spheres.

The following describes the approximate volume of solid waste to be disposed of, assuming linear relationships.

Present world output: 77,836 MW @ 2.23 $m^3$/KMW = 173.57 $m^3$/yr.

Future world output: 569,544 MW @ 2.23 $m^3$KMW = 1270.08 $m^3$/yr.

Total = 1443.65 $m^3$/yr.

Volume of bore available for waste: 0.3 m × 900 m deep (allows 100 m for cementing) = 65.7 $m^3$/bore.

When the bores are located 50 m from the edge of the subduction zone, in 1,000 years at 6 cm/year the entire line of boreholes is removed from the biosphere. When they are 50 m apart, 20 bores can be located per running kilometer. Solid waste in the amount of 1443.65 $m^3$ per year, requires 22 bores per year. Increasing the loading depth per bore to 990 m and cementing only 10 m requires 21 bores per year. This assumes a 100% load factor of solid borosilicate glass rods. Allowing for a 52% loss of usable volume due to the use of spheres, 43 boreholes are required. Disposal of 173.57 $m^3$ of solid waste (current world production) per year, requires 3 bores per year, or with spheres, 6 boreholes are required. From this it can be seen that several hundred kilometers of subduction zone on the Gorda Plate, and similiarily on the Pacific Plate, allow disposal for several hundred years when using only one row of boreholes.

What is claimed is:

1. The method of disposing of nuclear waste material wherein the earth has several subduction zones and includes a tetonic plate at each of these subduction zones that descends, adjacent a non-descending earth crust, into the central region of the earth comprising the steps of:

(a) drilling at least one borehole into said tectonic plate adjacent the non-descending earth crust;

(b) positioning said nuclear waste material in said bore hole; and (c) sealing the nuclear waste material in said borehole; whereby (d) said tectonic plate and said at least one borehole containing said nuclear waste material descend into the central region of the earth.

2. The method of disposing of nuclear waste comprising the steps of:

(a) drilling at least one borehole into a tectonic plate in the subduction region and adjacent the non-descending earth crust;

(b) placing said nuclear waste in said borehole; and (c) sealing the nuclear waste in said borehole; whereby (d) said tectonic plate and said at least one borehole containing nuclear waste descend into the central region of the earth.

3. The method of claim 2 wherein:

(a) said borehole is made in a tectonic plate that is covered by ocean water.

4. The method of claim 3 wherein:

(a) said nuclear waste is made in the form of a plurality of solid cylinders and said solid cylinders are sequentially loaded into said borehole by gravity action.

5. The method of claim 4 wherein:

(a) the diameter of said solid cylinder is slightly less than the diameter of said borehole.

6. The method of claim 5 wherein:

(a) said cylinder has a diameter of about 1 foot, a length of about 10 feet and consists of a slurry of hardened nuclear waste and glass.

7. The method of claim 3 wherein:

(a) said nuclear waste is made in the form of a plurality of solid spheres and said solid spheres are loaded into said borehole by gravity action.

8. The method of claim 7 wherein:

(a) the diameter of each of said spheres is substantially less than the diameter of said borehole.

9. The method of claim 8 wherein:

(a) each of said spheres has a diameter of about one inch and consists of a slurry of hardened nuclear waste and glass; and (b) the diameter of said borehole is about one foot.

10. The method of claim 3 wherein:

(a) said borehole is filled with said waste to a level that leaves an upper unfilled section of said borehole; and (b) said upper unfilled section of said borehole is then filled and sealed with cement.

11. The method of claim 10 wherein:

(a) said borehole is drilled to a depth of about 1,000 meters and has a diameter of about one foot.

* * * * *